United States Patent [19]

Lindmayer et al.

[11] Patent Number: 4,891,507

[45] Date of Patent: Jan. 2, 1990

[54] APPARATUS FOR EXTENDING THE INFRARED RESPONSE OF PHOTOCATHODES

[75] Inventors: Joseph Lindmayer, Potomac; Charles Y. Wrigley, Ijamsville, both of Md.

[73] Assignee: Quantex Corporation, Rockville, Md.

[21] Appl. No.: 281,634

[22] Filed: Dec. 9, 1988

[51] Int. Cl.[4] ..... H01J 31/50

[52] U.S. Cl. ..... 250/213 VT; 313/543

[58] Field of Search ..... 250/213 VT, 213 R; 313/542, 543, 544, 346 R

[56] References Cited

U.S. PATENT DOCUMENTS 3,870,921 3/1975 Burns ..... 313/542

3,971,932 7/1976 Sewell et al. ..... 250/213 VT

*Primary Examiner*—Edward P. Westin

*Attorney, Agent, or Firm*—Ostrolenk, Faber, Gerb & Soffen

[57] ABSTRACT

An efficient energy upconversion unit is optically coupled to a photocathode. The upconversion unit receives incident infrared electromagnetic energy of longer wavelengths and emits, in response, electromagnetic energy within a band of shorter wavelengths to which the photocathode is more responsive. Through such energy upconversion, the photoresponse of the cathode is extended to much longer infrared wavelengths.

12 Claims, 6 Drawing Sheets

APPARATUS FOR EXTENDING THE INFRARED RESPONSE OF PHOTOCATHODES

BACKGROUND OF THE INVENTION

This invention relates generally to apparatus employing photocathodes and, more particularly, to an upconverter which allows operation of such apparatus beyond the normal cut-off of the cathode, thereby making possible processing of relatively long wavelength infrared light.

Sensitivity, that is, the ability to develop useful information from weak signals, is a desirable characteristic of photocathode devices, such as photomultipliers and image intensifiers. However, prior art photocathode devices display rapidly decreasing spectral sensitivity at longer wavelengths, culminating in a complete cut-off at wavelengths beyond 1 micron. An example of this is found in night vision equipment which can sense and provide an image of a target weakly illuminated by ambient or by a conventional infrared searchlight but which cannot "see," or may even be damaged by, incident infrared laser light above 1 micron wavelength.

It is therefore an important object of this invention to provide photodetection apparatus which is highly sensitive to infrared radiation and thereby capable of providing useful information regarding longer wavelength infrared images.

A more general object of the invention is to provide new and improved apparatus for use in the infrared.

A more specific object of the invention is to provide night vision equipment having sensitivity to infrared signals arising from various sources.

BRIEF DESCRIPTION OF THE DRAWINGS

These and other features and advantages of the present invention will become apparent when the following text is read in conjunction with the accompanying drawings, in which.

DESCRIPTION OF THE PREFERRED EMBODIMENTS

Figure 1:
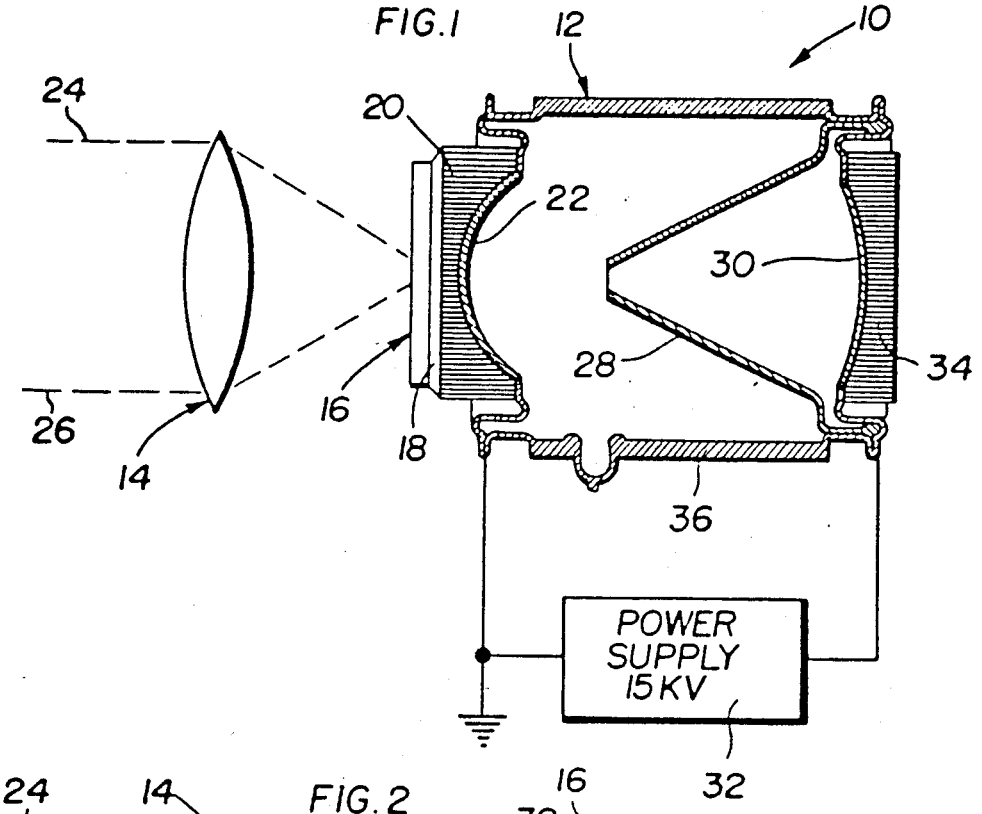
FIG. 1 is a schematic view of photodetection apparatus constructed in accordance with the present invention and including an image intensifier tube.

Referring now in detail to the drawings, specifically to FIG. 1, photodetection apparatus useful as night vision equipment is indicated generally by the reference numeral 10. Apparatus 10 comprises a photosensor 12 which takes the form of a conventional image intensifier tube, a collecting lens 14, and an energy upconverter 16 disposed between the collecting lens 14 and the photosensor 12 . In the first embodiment, the energy converter 16 is mounted directly on the photosensor 12 in optically coupled relationship, either by means of a suitable adhesive or as a thin film directly deposited on the optical input face of photosensor 12.

The image intensifier tube which comprises the photosensor 12 includes a fiber optic faceplate 20 and a layer 22 of photoemissive material deposited on the inner surface of the faceplate 20 to form a photocathode. Radiation from a target area is shown by the lines 24 and 26; this incident radiation is collected as an image by the lens 14, this image being ultimately coupled through the fiber optic faceplate 20 onto the photocathode 22. Photocathode 22 emits electrons in quantities determined by its own spectral sensitivity and the wavelengths of the received radiation. The electrons emitted by the photocathode 22 are focused by means of an electron optics device 28 onto a screen 30 of cathodoluminescent phosphor material. In accordance with conventional practice, an accelerating voltage from a power supply 32 is applied between the screen 30 and the photocathode 22 to increase the energy of the flowing electrons. Power supplies having a nominal accelerating potential of 15 kilovolts are useful for this purpose.

The electrons from photocathode 22 which strike the screen 30 excite the phosphor material, producing optical photons; these photons are coupled out of the image intensifier tube by means of a fiber optics bundle 34 upon which the screen 30 is deposited. As will be appreciated, the intensified optical image at the exit of the fiber optics bundle 34 may be further amplified, viewed directly, or processed by a number of standard means.

The photosensor which comprises the image intensifier tube includes a housing or envelope 36 which properly positions the faceplate 20, the photocathode 22, the electron optics 28, the screen 30, and the fiber optics bundle 34.

The various photocathodes known tend to lose their sensitivity very rapidly near 1 micron. Assuming that the photocathode 22 is a conventional S-20 photocathode, the spectral sensitivity, as measured in microamperes per watt, has a maximum value corresponding to a wavelength of about 0.66 microns. The spectral sensitivity of such a common photocathode decreases rapidly with increasing wavelength, and such a photocathode is generally considered insensitive to wavelengths greater than 0.95 micron. In accordance with the present invention, such a limitation is overcome by use of the energy upconverter 16. This latter device is arranged to receive electromagnetic energy of wavelengths longer than those to which the photocathode 22 is sensitive and to emit, in response thereto, electromagnetic energy at wavelengths to which the photocathode 22 is normally usefully sensitive. Moreover, the energy upconverter 16 is arranged to be substantially optically transparent to a majority of the radiation wavelengths within the sensitivity range of the photocathode in order to take full advantage of the overall information gathering capabilities of the photodetection device 10.

Figure 2:
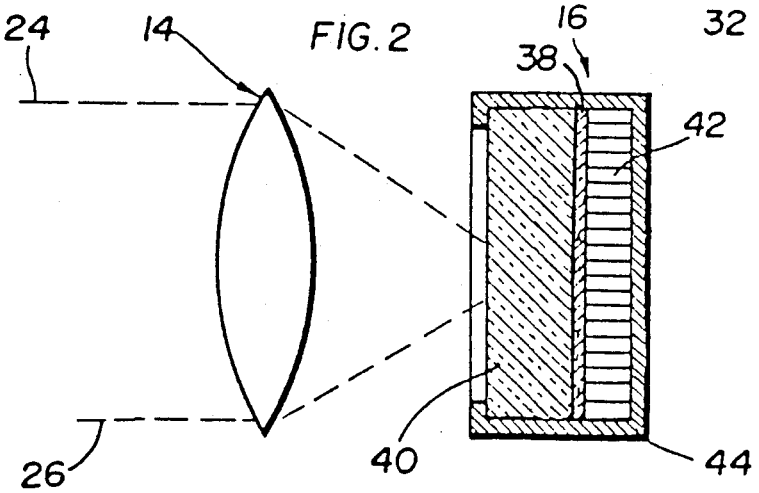
FIG. 2 is a central sectional view of an energy upconverter constructed for use in the photodetection apparatus of FIG. 1.

In the specific instance wherein it is desired to employ an S-20 photocathode while deriving information from incident infrared light at a wavelength range of 0.95 to about 2 microns, the energy upconverter 16 of the invention is constructed as illustrated in FIG. 2. There, a layer 38 of upconverting material is deposited on an optically transparent window 40, preferably formed of sapphire or some other transparent substrate. A fiber optics disc 42 is disposed adjacent layer 38 to collimate the visible light output from layer 38, thereby preventing any loss in resolution which might occur from a gap between converter 16 and faceplate 20. Window 40, layer 37 and disk 42 are sealed in container 38, the entire package forming upconverter plate 16. Alternatively, a layer of upconverting material 38 can be deposited directly on the faceplate 20 itself.

An eminently useful material for the layer 38 is an infrared stimulable phosphor, composed of CaS and doped with Eu and Sm, as described in co-pending patent application Ser. No. 147,215, filed Jan. 27, 1988, assigned to the same assignee as the present invention. This preferred material is chargeable with visible wavelengths and will remain charged for extremely long times. The infrared phosphor can then be stimulated by wavelengths approaching 2 microns to emit at wavelengths around 0.62 micron, the latter wavelength region being within the useful spectral sensitivity of an S-20 photocathode.

As will be appreciated for the foregoing description, the present invention employs a material for the layer 38 which can be stimulated by a wide range of longer-wavelength infrared signals and will re-emit light at shorter wavelengths. Most materials that absorb and re-radiate energy, re-radiate at wavelengths which are longer than those absorbed. However, there is a class of materials, called Anti-Stokes materials, which can absorb multiple photons of an infrared wavelength at an atomic-scale site and subsequently emit one visible-wavelength photon. A device which employs Anti-Stokes materials in upconversion for photocathode devices is set forth in U.S. Pat. No. 3,971,932 to Sewell et al. Unfortunately, Anti-Stokes materiass necessarily only absorb in very narrow wavelength bands. Also, Anti-Stokes devices have extremely low conversion efficiencies, so they are not useful in low light situations.

Accordingly, instead of using Anti-Stokes materials as for layer 38, the present invention employs novel active materials which can separately store the energy necessary to later provide higher-energy shorter-wavelength photons upon lower-energy longer-wavelength photon excitation until the chosen time for imaging use of the apparatus. Such materials, as described in co-pending application Ser. No. 147,215, assigned to the same assignee, can absorb such energy from sunlight or artificial sources and store a portion thereof for very significant times as the energy of electrons trapped in elevated-energy states. Upon arrival of lower energy photons, the trapped electrons provide wide-band response with an essentially intensity-independent conversion efficiency to produce short-wavelength light at or near the peak response of the photocathode. Employing these active materials as the conversion medium thereby overcomes the limitations of narrow bandwidth and effective conversion only at high intensities of the passive material approach taught in U.S. Pat. No. 3,971,932 to Sewell et al., and renders the imaging device practical for use with low incident intensities over wide bands of wavelength.

The active material employed in the present invention will now be described in detail. The material preferably comprises: a base material selected from a group of alkaline earth metal sulfides, such as calcium sulfide; a first dopant of samarium; a second dopant selected from the group of europium oxide, europium fluoride, europium chloride, and europium sulfide; and up to 10 parts fusible salt for every 90 parts of base material by weight. Optionally, barium sulfate may be added at the rate of up to 10 parts for every 90 parts of base material by weight.

Two exemplary mixtures for the preferred material are now described:

| EXAMPLE 1 | |
|---|---|
| Calcium sulfide | 90 parts |
| Barium sulfate | 5.5 parts |
| Lithium fluoride | 10 parts |
| Samarium | 150 parts per million |
| Europium sulfide | 550 parts per million |

As used above and throughout this application, "parts" and "parts per million" shall refer to parts by weight unless otherwise noted.

The mixture is placed into a graphic crucible within a furnace flushed with a dry nitrogen atmosphere (derived from a liquid source) or other dry inert atmosphere such as argon, and heated to between 950° C. and 1300° C. (preferably 1100° C.) for 30 minutes to one hour such that a fused mass is formed. For longer heating times, the fused mass could be formed at temperatures as low as 950° C. Temperatures as high as 2000° C. could be used to form such a fused mass in shorter times.

After cooling, the fused mass is ground using standard techniques into a powder having a particle size of between 10 and 100 microns. A particle size of 2 microns or less is preferable if thin film techniques are to be used.

After grinding, the powdered material is heated to about 300° C. to 700° C. (preferably 600° C.) in the graphite crucible within the nitrogen or other inert atmosphere furnace. This second heating is below the fusing temperature of the material (about 700° C.) and is maintained for 10 to 60 minutes (preferably 30 minutes). This second heating step removes internal stresses and repairs damage done to the crystalline surfaces during the grinding step.

After the second heating, the material is cooled and the powdered material is then mixed with a suitable binder or vehicle such acrylic, polyethylene, or other organic polymer.

After the material has been mixed with a transparent binder, it is applied as a thin coating onto a transparent substrate 40 or directly onto the optical input faceplate 20 of photosensor 12. The coating of the photoluminescent material is preferably between 1 and 50 microns in thickness if the upconverter plate is used for extending the infrared response of an image intensifier; the coating can be up to 100 microns in thickness if the photoluminescent plate is used for extending the infrared response of a photomultiplier, since no imaging is involved in such an application.

In the above mixture, the calcium sulfide serves as a base material whereas the lithium fluoride operates to provide the fusibility characteristics useful for the specific embodiment. Alternatively, other alkaline earth metal sulfides might be used as a base material.

The barium sulfate in the above mixture is used to improve the brightness of output light from the material. Preferably 5.5 parts are used as noted above, but between 1 and 10 parts may be used of the barium sulfate as well as between 1 and 10 parts of lithium fluoride relative to the 90 parts of calcium sulfide. The barium sulfate is not absolutely essential, but will greatly improve the optical characteristics of the material.

The samarium and europium sulfide in the above mixture are used for establishing the communication band and the electron trapping level. Preferably 150 parts per million of samarium are used, but the samarium could alternatively be between 20 parts per million and 300 parts per million. The europium sulfide may be between 100 and 900 parts per million with 400 to 600 parts per million being preferred and 550 parts per million being the optimal value. Europium chloride, europium fluoride or europium oxide could be used in lieu of europium sulfide.

Figure 4:
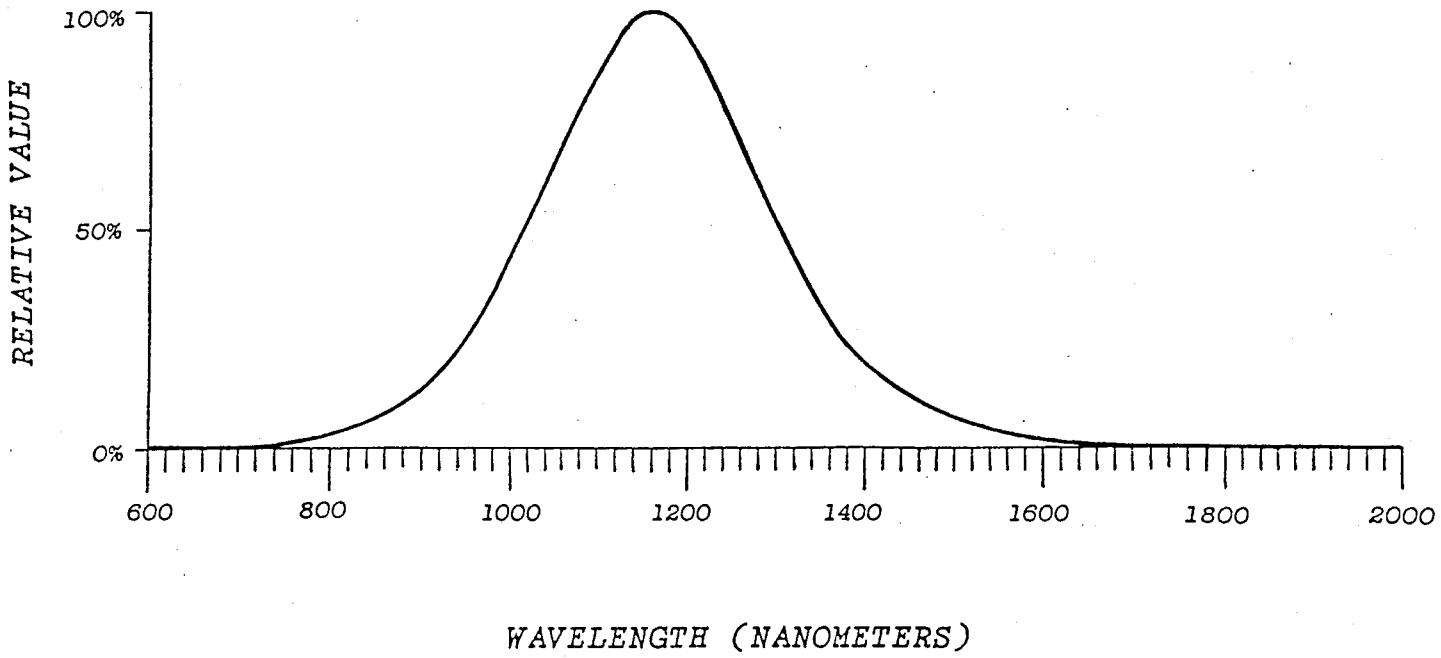
FIG. 4 shows the IR sensitivity of the photoluminescent material of the present invention.
Figure 5:
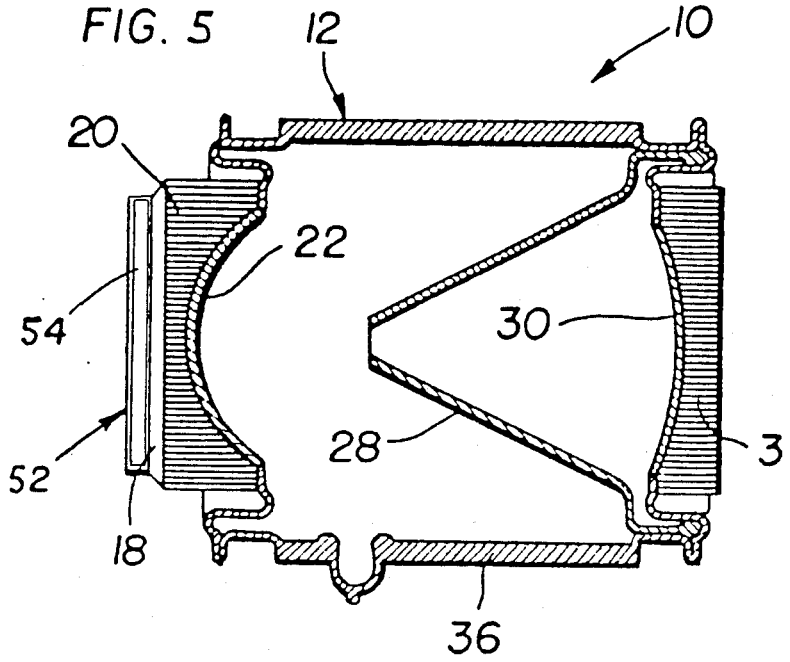
FIG. 5 shows an embodiment of the invention with replaceable upconverter plates.

The mixture resulting from the above process provides a depth for electron traps of about 1.1 electron volts below the communication band and has an output spectrum as shown in FIG. 4, which illustrates that the center frequency of the output has a wavelength of approximately 650 nanometers corresponding to a reddish-orange light. The IR sensitivity as shown in FIG. 5 has an expanded range, peaking at about 1150 nm.

EXAMPLE 2

A second photoluminescent material for upconversion may be made with the following composition:

| | |
|---|---|
| Calcium sulfide | 90 parts |
| Barium sulfate | 5 parts |
| Lithium fluoride | 10 parts |
| Samarium | 100 parts per million |
| Europium oxide | 750 parts per million |

The above mixture is processed in the same manner as that of Example 1 by first heating to fusing, grinding the resultant fused mass, and then reheating at a temperature below the fusing temperature but sufficiently high to allow repair of damage to the crystalline parts. Cooling may be used after each of the heating and reheating steps. The same process steps, in terms of temperature and time intervals, may be used in processing this second material. The resulting powder may be ground as with Example 1, combined with a transparent binder or vehicle, and applied to the optically transparent window 40, or directly on the faceplate 20 of the photocathode.

Figure 3:
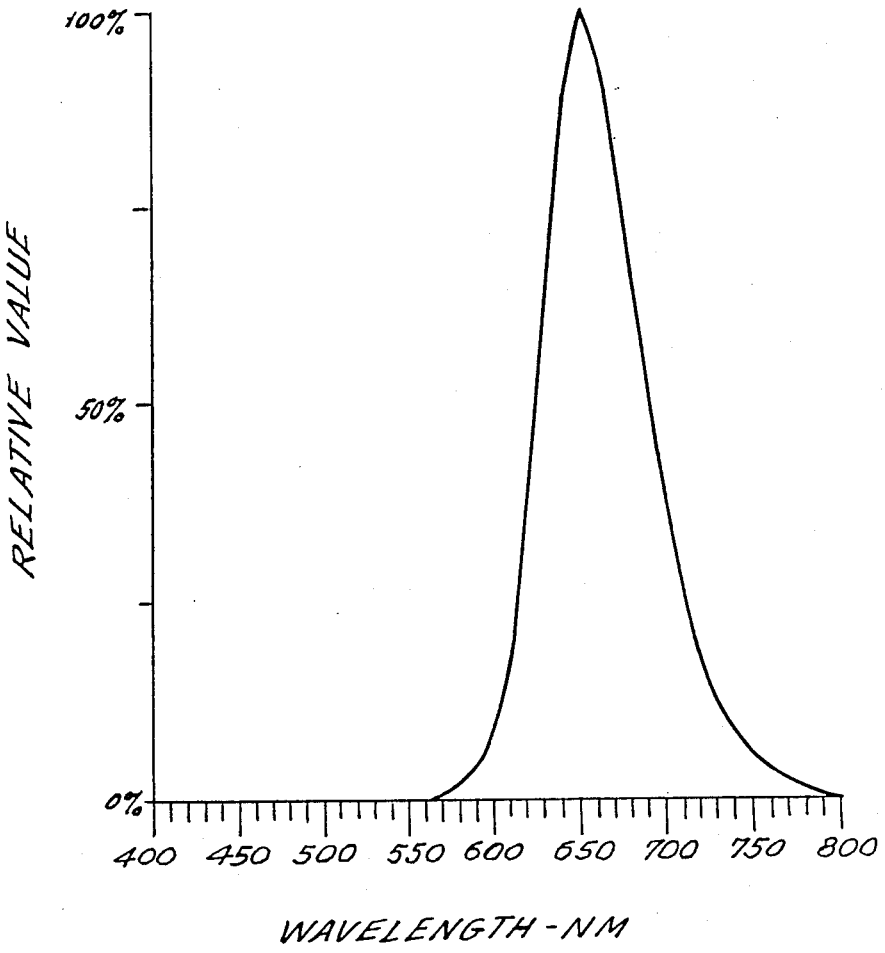
FIG. 3 shows the spectrum of light output by the photoluminescent material according to the present invention.

In the above mixture, the barium sulfate may vary from zero up to 10 parts, the lithium fluoride may vary between 2 and 10 parts, the samarium may vary between 20 and 300 parts per million, and the europium oxide may vary between 300 and 1500 parts per million. The specific values for portions which are given above provide highly superior characteristics such as sensitivity. The second material charges up very quickly with light. The material holds the charge for extended periods of time similar to the first material and will trigger re-emission of visible light at a wavelength of about 650 nanometers (reddish-orange light) upon application of an infrared source. The emission spectrum under IR stimulation is illustrated in FIG. 3 and the IR sensitivity is illustrated in FIG. 4.

The materials of Example 1, within the ranges specified, can also be deposited upon window 40 or faceplate 20 by physical techniques such as physical vapor deposition (evaporation, sputtering, etc.) or chemical vapor deposition, ion beam deposition, molecular beam deposition, and electron beam deposition if high resolution (submicron) is desired. The listed materials can be mixed and then physically deposited on the substrate or the materials can be individually deposited; however, this is much more difficult and provides no additional benefits. A particularly successful method has been to mix the materials, hot press them into a solid and then evaporate or sputter them onto window 40 or faceplate 20.

The materials and substrate are placed into a furnace and fused under the condition of Example 1, over a temperature range of 600° C. to 1100° C., preferably at 900° C. Because the photoluminescent materials bonds so well, the use of separate binders or vehicles is not necessary. The lithium fluoride can also be omitted to obtain equally good results.

The above-described physical deposition process could also be used with the starting materials of Example 2. The fusing step could be accomplished under the conditions of Example 1 or as described immediately above.

Obviously, the particular type of material employed in the present invention depends upon the sensitivity desired. The above described material is considered optimum for most applications because it causes the greatest shift in response i.e., it is sensitive to light of relatively long wavelengths. However, if sensitivity to shorter infrared wavelengths is more important, e.g. detection of the output of a Nd:YAG laser, the optimum material would be that disclosed in Ser. No. 034,334, filed Apr. 3, 1987, now allowed, or Ser. No. 078,829, filed July 28, 1987, both assigned to the present assignee. Examples of other types of suitable electron trapping materials are described in Ser. No. 034,333, filed Apr. 3, 1987, now allowed, and Ser. No. 085,465, filed Aug. 14, 1987, now allowed, both assigned to the present assignee. All of these materials are formed of an alkaline earth metal base and appropriate dopants.

Although FIGS. 1 and 2 illustrate upconverter 16 mounted permanently on photosensor 12, the apparatus 10 could also be constructed as shown in FIG. 5, with a slot 52 over faceplate 20 to permit various replaceable upconverter plates 54 to be used depending upon the infrared sensitivity desired. Alternatively, a snap-fit arrangement could be employed in lieu of a slot to permit the use of replaceable plates of different 1R sensitivities.

Figure 6A:
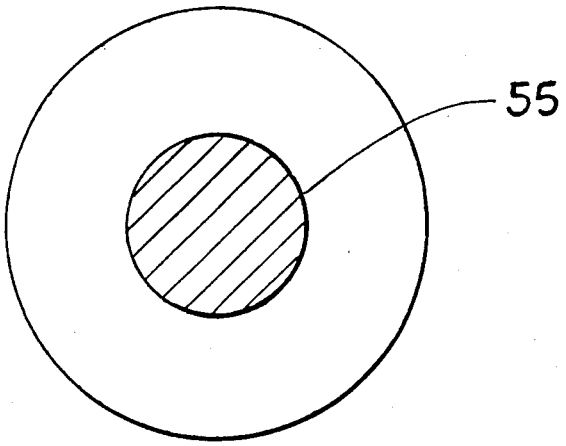
FIGS. 6A and 6B show exemplary configurations of upconverter plates in which the upconverting material does not entirely cover the field of view of the photosensor.
Figure 6B:
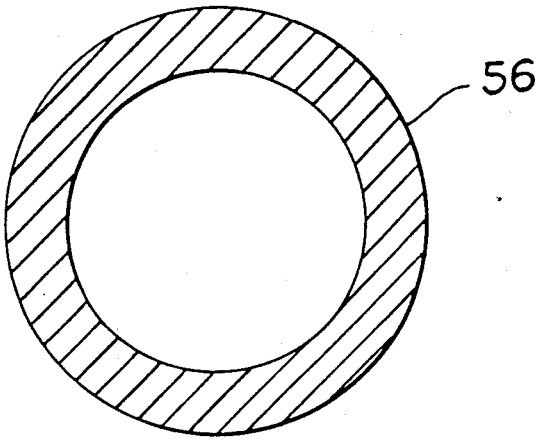

In a further embodiment of the invention, upconverting material 38 is disposed in only a portion of an otherwise transparent plate so that it does not cover the entire field of view of photosensor 12. For example, the upconverting material 38 could be disposed as a spot 55 at the center of the plate (FIG. 6A), or as a ring 56 around the periphery of the plate (FIG. 6B). Such types of arrangements permit the user of apparatus 10 to see the visible background as well as the infrared emitting sources detected by upconverting material 38.

Figure 7:
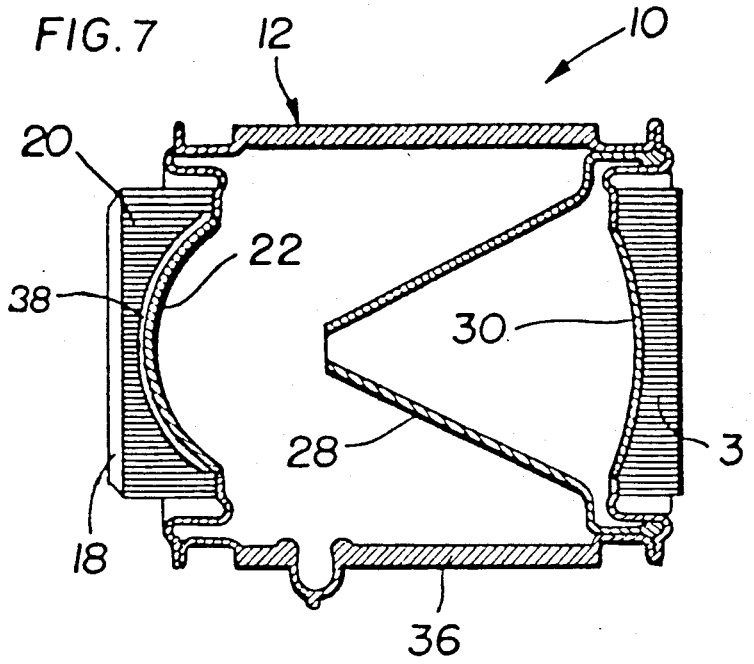
FIG. 7 shows an embodiment of the invention in which the upconverting material is permanently disposed inside the apparatus.

In a still further embodiment of the apparatus shown in FIG. 7, a rugged, permanent device can be obtained by disposing upconverting material 38 inside, rather than outside, fiberoptic faceplate 20. This embodiment would require a visible light source within the apparatus, such as green or blue LED's, to charge up material 38, because visible light would not otherwise reach the material.

Figure 8:
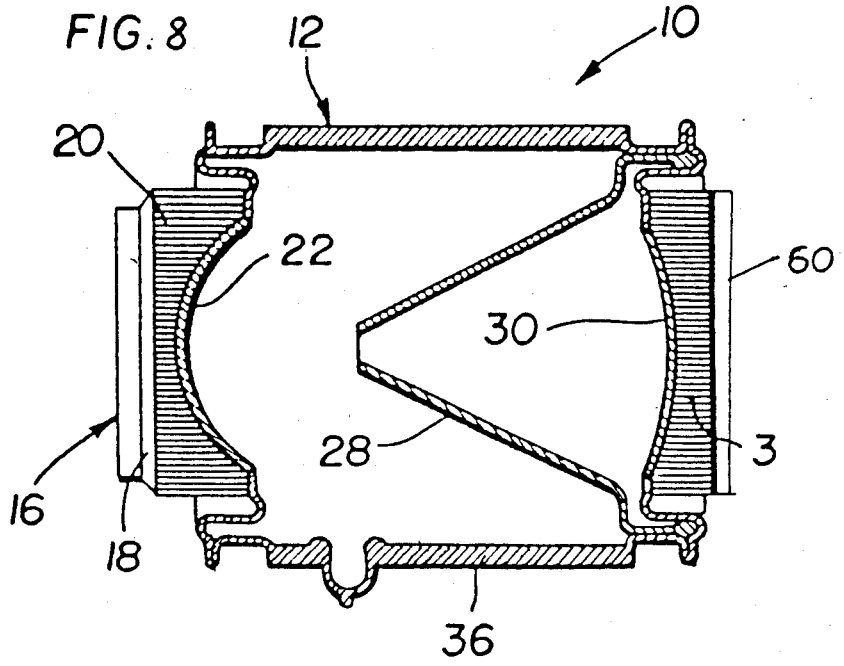
FIG. 8 shows an embodiment of the invention with a CCD sensor disposed at the output of the image intensifier tube.

If a CCD output is desired for video or other purposes, apparatus 10 can be constructed as shown in FIG. 8, with a CCD unit 60 disposed at the output of the fiber optics bundle 34 of the image intensifier tube.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. Photodetection apparatus comprising:

photosensitive means usefully responsive to electromagnetic energy in a first wavelength region;

active pre-charged photon energy conversion means for receiving electromagnetic energy of wavelengths longer than said first wavelength region and in a region to which said photosensitive means is insensitive and emitting electromagnetic energy in said first wavelength region in response thereto, said energy conversion means being substantially optically transparent to radiations over a substantial portion of said first wavelength region; and means optically coupling said energy conversion means to said photosensitive means, including direct physical contact thereto, whereby said photosensitive means provides information concerning incident electromagnetic energy in both said first wavelength region and at said longer wavelengths.

2. Photodetection apparatus according to claim 1, wherein said photosensitive means comprises an image intensifier tube.

3. Photodetection apparatus according to claim 1, wherein said photon energy conversion means comprises a material which emits electromagnetic energy of shorter wavelengths than the wavelengths of the incident electromagnetic energy; and a carrier for said material.

4. Photodetection apparatus according to claim 3, wherein said material comprises a base of calcium sulfide.

5. Photodetection apparatus according to claim 4, wherein said material further comprises dopants of europium and samarium.

6. Photodetection apparatus according to claim 3, wherein said carrier is the fiber-optic faceplate of a photosensitive means.

7. Photodetection apparatus according to claim 3, wherein said carrier material comprises a sapphire substrate.

8. Photodetection apparatus according to claim 1, wherein said apparatus further includes housing means for said photon energy conversion means and said photosensitive means.

9. Photodetection apparatus according to claim 2, wherein said photon energy conversion means is disposed in a replaceable plate which fits over said image intensifier tube.

10. Photodetection apparatus according to claim 2, wherein said photon energy conversion means is permanently disposed within said image intensifier tube.

11. Photodetection apparatus according to claim 2, wherein said photon energy conversion means covers only a portion of the field of view of said image intensifier tube.

12. Photodetection apparatus according to claim 2, further comprising a CCD sensor disposed at the output of said image intensifier tube.

* * * * *